US010163537B2

(12) United States Patent
Hamilton

(10) Patent No.: US 10,163,537 B2
(45) Date of Patent: Dec. 25, 2018

(54) DEVICE FOR CONVERTING RADIATION ENERGY TO ELECTRICAL ENERGY

(71) Applicant: Ian Christopher Hamilton, Fort Wayne, IN (US)

(72) Inventor: Ian Christopher Hamilton, Fort Wayne, IN (US)

( * ) Notice: Subject to any disclaimer, the term of this patent is extended or adjusted under 35 U.S.C. 154(b) by 701 days.

(21) Appl. No.: 14/701,602

(22) Filed: May 1, 2015

(65) Prior Publication Data

US 2015/0318065 A1 Nov. 5, 2015

Related U.S. Application Data

(60) Provisional application No. 61/987,655, filed on May 2, 2014, provisional application No. 62/103,420, filed on Jan. 14, 2015, provisional application No. 62/132,007, filed on Mar. 12, 2015.

(51) Int. Cl.
*G21H 1/08* (2006.01)
*G21H 1/00* (2006.01)

(52) U.S. Cl.
CPC ..... *G21H 1/08* (2013.01); *G21H 1/00* (2013.01)

(58) Field of Classification Search
CPC ..... G21H 1/08; G21H 1/00
USPC ..... 310/302; 250/493.1; 136/252, 254, 265
See application file for complete search history.

(56) References Cited

U.S. PATENT DOCUMENTS 685,957 A 11/1901 Tesla
685,958 A 11/1901 Tesla
3,462,310 A * 8/1969 Rubenstein ..... G21H 1/08 310/306
4,242,147 A 12/1980 Detoia
4,292,579 A * 9/1981 Constant ..... H01L 35/00 310/306
5,087,533 A 2/1992 Brown
5,396,141 A 3/1995 Jantz
5,590,031 A * 12/1996 Mead, Jr. ..... H02M 11/00 342/6
5,721,462 A * 2/1998 Shanks ..... G21H 1/04 310/303
6,627,897 B1 9/2003 Francke et al.
8,294,023 B2 10/2012 Clothier
8,309,942 B2 11/2012 Lal et al.
8,552,616 B2 10/2013 Prelas
8,691,404 B2 4/2014 Kwon
8,742,363 B2 6/2014 Munchmeyer
2010/0037938 A1 2/2010 Jackson
2010/0043434 A1 2/2010 Ortiz
2010/0233518 A1* 9/2010 Kwon ..... G21H 1/00 429/7
2011/0068656 A1* 3/2011 Lee ..... G01N 29/022 310/313 C
2011/0074253 A1* 3/2011 Hino ..... F03G 7/005 310/365
2011/0298333 A1 12/2011 Pilon
2012/0048322 A1 3/2012 Ghoshal
(Continued)

FOREIGN PATENT DOCUMENTS

WO WO-2010/128461 A1 11/2010

*Primary Examiner* — Michael Andrews
(74) *Attorney, Agent, or Firm* — Indiana University Maurer School of Law IP Legal Clinic

(57) ABSTRACT

The present disclosure relates to a device for conversion of one type of energy into another type of energy. Specifically, the device converts radiation energy into electrical energy.

37 Claims, 14 Drawing Sheets

(56) References Cited

U.S. PATENT DOCUMENTS

| | | | | |
|---|---|---|---|---|
| 2012/0137877 | A1* | 6/2012 | Zauderer | H02K 44/18<br>95/42 |
| 2013/0112242 | A1 | 5/2013 | Hoffman | |
| 2013/0118550 | A1* | 5/2013 | Sahin | H01L 31/042<br>136/246 |
| 2013/0274094 | A1 | 10/2013 | Velasquez | |

* cited by examiner

DEVICE FOR CONVERTING RADIATION ENERGY TO ELECTRICAL ENERGY

CROSS-REFERENCE TO RELATED APPLICATIONS

This application claims the benefit of U.S. Provisional Application No. 61/987,655, filed May 2, 2014, entitled "Device For Converting Radiation Energy To Electrical Energy" to Ian Hamilton, and U.S. Provisional Application No. 62/103,420, filed on Jan. 14, 2015, entitled "Device For Converting Radiation Energy To Electrical Energy" to Ian Hamilton, and U.S. Provisional Application No. 62/132,007, filed on Mar. 12, 2015, entitled "Device For Converting Radiation Energy To Electrical Energy" to Ian Hamilton the disclosures of which are expressly incorporated by reference herein.

BACKGROUND AND SUMMARY OF THE PRESENT

The present disclosure relates to converting radiation energy to electrical energy.

Exciting as gas results in the ionization of that gas. Ionization causes the separation of positive and negative particles. According to one embodiment of the present disclosure, this separation of positive and negative particles may be used to create electrical energy.

In one embodiment of the present disclosure, a device for converting radiation energy to electrical energy includes an electrical potential source having a first terminal and a second terminal. The device additionally includes a first conductive material coupled to the first terminal, and a second conductive material electrically coupled to the second terminal. The device further includes a third conductive material capacitively coupled to the first conductive material and a fourth conductive material capacitively coupled to the second conductive material. Additionally, the device includes a radiation receiving area. The third conductive material and fourth conductive material are electrically coupled together to create an electrical current from an electrical potential resulting from radiation received in the radiation receiving area.

In another embodiment of the present disclosure, a device for converting potential energy to electrical energy includes an electrical potential source having a first terminal and a second terminal. The device additionally includes as first conductive material that is electrically coupled to the first terminal, and a second conductive material that is electrically coupled to the second terminal. The device further includes a third conductive material positioned inwardly of the first conductive material, and a fourth conductive material positioned inwardly of the second conductive material. Additionally, the third conductive material and the fourth conductive material are spaced apart to define a space adapted to receive a gas. The third and fourth conductive materials are also electrically coupled together to create an electrical flow generated by an electrical potential resulting from a self-ionization of the gas.

In another embodiment of the present disclosure, a method of generating electrical current comprises providing a radiation receiving area for receiving radiation, providing a negatively biased conducive material, and providing a positively biased conductive material. The method further includes causing, by receiving radiation from a radiation source, a plurality of atoms to lose an electron, receiving, by the positively biased conductive material, the plurality of electrons, and receiving, by the negatively biased material, a plurality of positively charged particle. The negatively biased conductive material is electrically coupled to the positively biased conductive material to create an electrical current generated by the receiving radiation.

Additional features of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
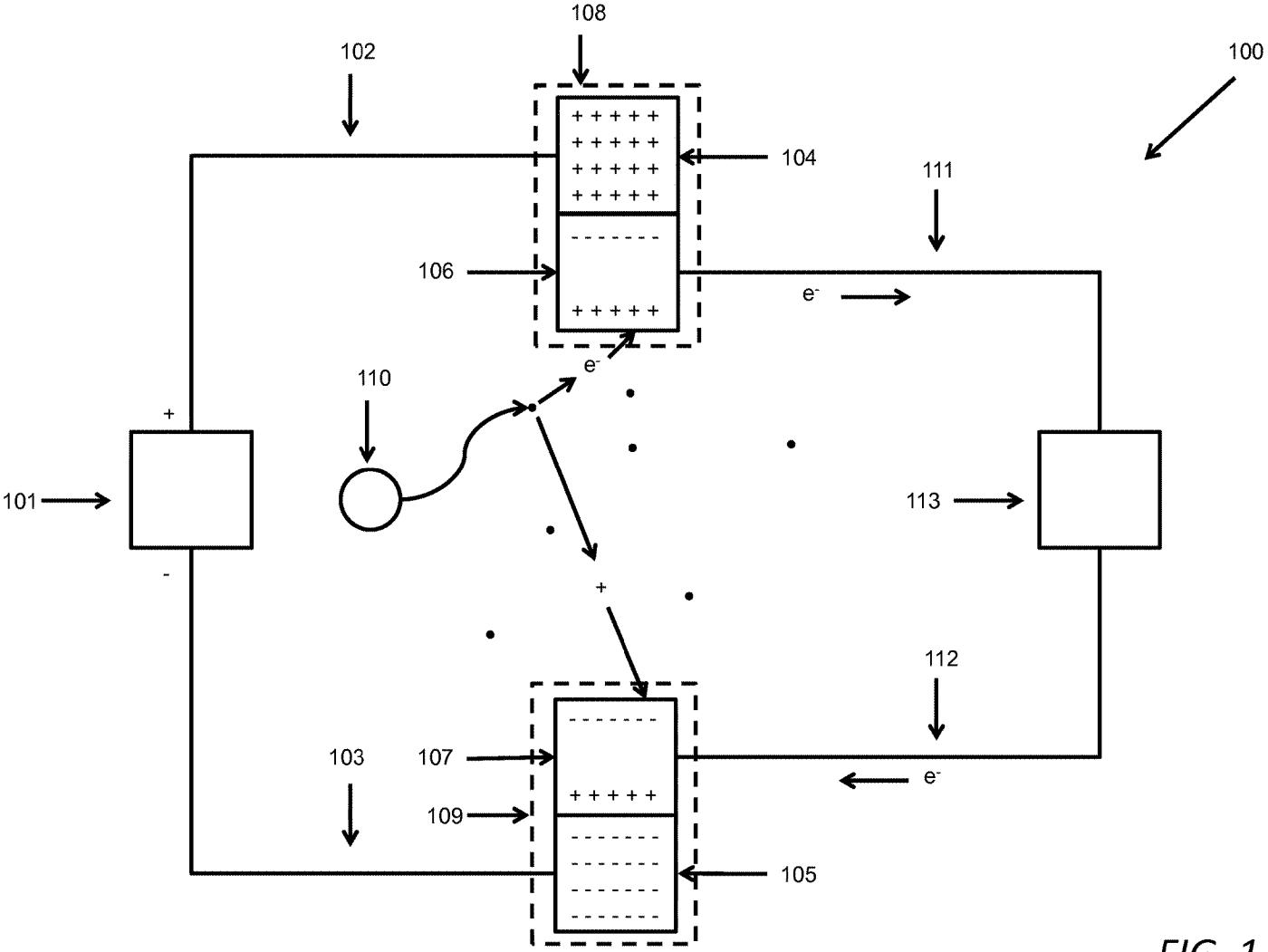
FIG. 1 illustrates schematically a device for converting radiation energy to electrical energy.

As depicted in FIG. 1, a device 100 for converting radiation energy to electrical energy includes an electrical potential source 101 having a first terminal 102 and a second terminal 103. In one embodiment, the first terminal 102 may comprise a cathode and the second terminal 103 may comprise an anode. In one aspect, the first terminal 102 and the second terminal 103 may comprise leads made from aluminum, silver, copper, gold, magnesium, tungsten, nickel, mercury, platinum, iron, graphite or other conductive materials. Device 100, depicted in FIG. 1, additionally comprises as first conductive material 104 that is electrically coupled to the first terminal 102, and a second conductive material 105 that is electrically coupled to the second terminal 103. In one aspect, the first conductive material 102 and the second conductive material 103 may comprise a connector plug, which increases the likelihood of insulation of the entire device 100. Furthermore, a third conductive material 106 abuts the first conductive material 104, and a fourth conductive material 107 abuts the second conductive material 195. Together, the first conductive material 104 and the third conductive material 106 constitute a first charged pair 108. Together, the second conductive material 105 and the fourth conductive material 107 constitute a second charged pair 109.

In another aspect, there may be an electrically isolating material positioned between the first conductive material 104 and the third conductive material 106 in order to decrease the likelihood of the depletion of the charge of the first conductive material 104. Similarly, there may be an electrically isolating material positioned between the second conductive material 105 and the fourth conductive material 107 in order to decrease the likelihood of the depletion of the charge of second conductive material 105. In one embodiment, the first, second, third, and fourth conductive materials 104, 105, 106, 107 may comprise aluminum, silver, copper, gold, magnesium, tungsten, nickel, mercury, platinum, iron, and/or graphite.

As further depicted in FIG. 1, a radiation source 110 may emit gamma rays. In another aspect, the radiation source 110 may be positively charged. Additionally, the third and fourth conductive materials 106, 107 are electrically coupled together though a third terminal 111 and a fourth terminal 112 to create an electrical flow through a load 113, generated by an electrical potential resulting from the radiation source 110. The radiation source 110 causes the excitation of a gas 210 (shown in FIG. 2). Exciting the gas 219 results in its ionization, which causes the separation of positive and negative particles. For example, an atom may lose an electron during ionization. This results in an abundance of electrons on the third conductive material 106 and a collection of protons on the fourth conductive material 107. The net result is the a flow of electric current through load 113 from the third conductive material 106 to the fourth conductive material 107. The flow of electric current through load 113 may be measured by an oscilloscope.

Figure 2:
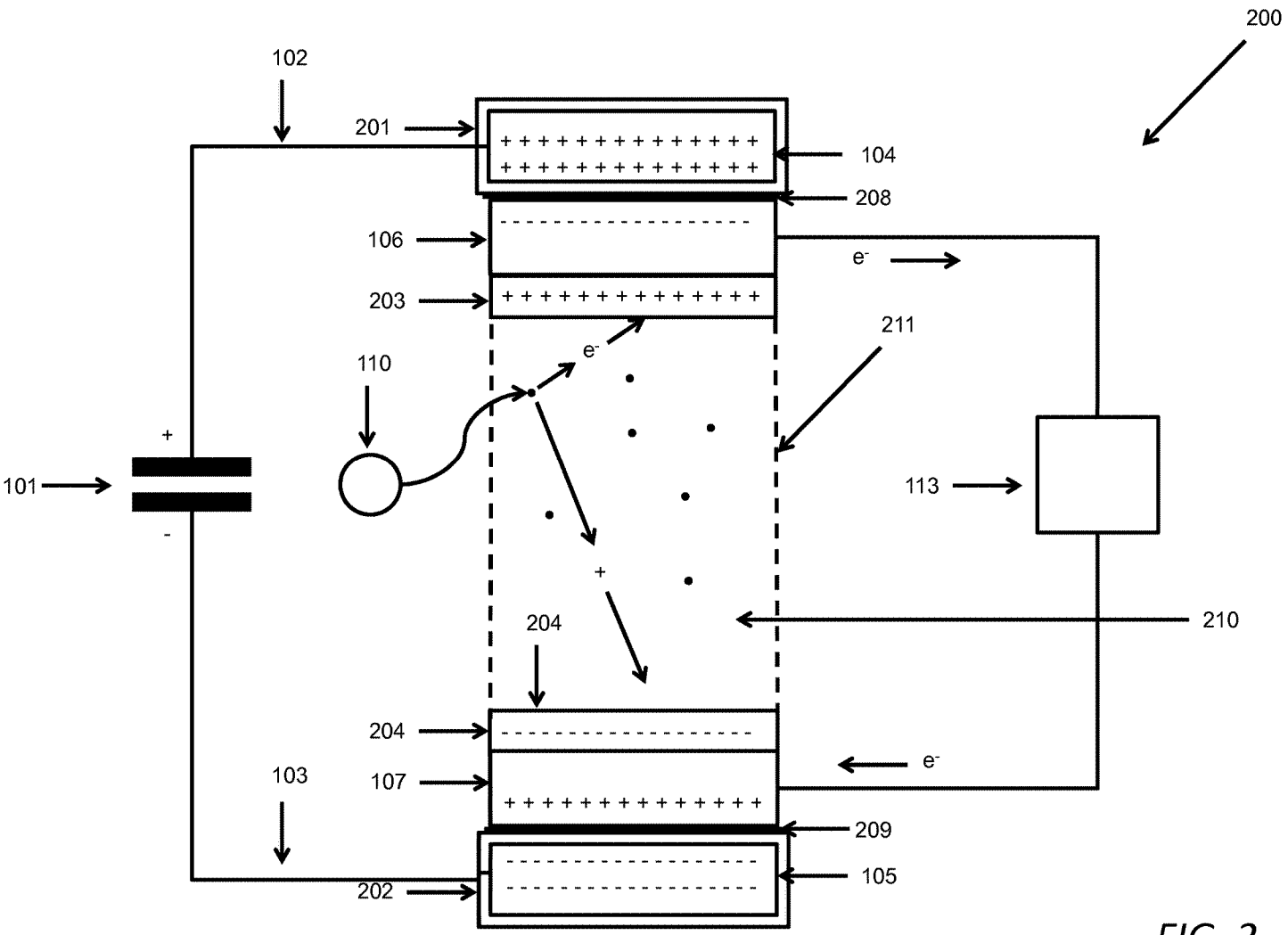
FIG. 2 schematically illustrates an additional embodiment of a device for converting radiation energy to electrical energy.

Referring to FIG. 2, an alternative embodiment of device 100 is shown as device 200 and includes first, second, third, and fourth conductive materials 104, 105, 106, 107, and electrical potential source 101. Together, the first conductive material 104 and the third conductive material 106 constitute a first charged pair 108. Together, the second conductive material 105 and the fourth conductive material 107 constitute a second charged pair 109. In addition, a first oxide material 201 surrounds the first conductive material 104, and a second oxide material 202 surrounds the second conductive material 105. In one aspect, the first oxide material 201 and the second oxide material 202 may comprise aluminum oxide. In an alternative embodiment, a first electrically isolating material 208 may be positioned between the first conductive material 104 and the third conductive material 106. A second electrically isolating material 209 may also be positioned between the second conductive material 105 and the fourth conductive material 107. In one embodiment, the first and second electrically isolating materials may comprise electrical insulation paper, acetate, acrylic, beryllium oxide, ceramic, Debin®, epoxy/fiberglass, glass, Kapton®, Teflon®, Kynar®, Lexan® and Merlon®, melamine, mica, neoprene, Neomex®, polyethylene terephthalate, phenolics, polyester, polyolefins, polystyrene, polyvinylchloride silicone, thermoplastics, polyurethane, vinyl, laminates, or other electrically isolating materials.

As also depicted in FIG. 2, device 200 may optionally include a first transition metal material 203 abutting the third conductive material 106 and a second transition metal material 204 abutting the fourth conductive material 107. In one aspect, the first transition metal material 203 and the second transition metal material 204 may comprise gold or silver.

Furthermore, device 200 as depicted in FIG. 2 may comprise a radiation receiving area 211 separating the third conductive material 106 and the fourth conductive material 107. The radiation receiving area 211 is adapted to receive radiation from the radiation source 110. In one embodiment, the radiation receiving area 211 comprises a noble gas 210 that is positioned within the radiation receiving area 211 that is adapted to receive radiation. In addition, the electrical potential source 101 may be a capacitor or super-capacitor. The capacitor is preferably charged to approximately 800 volts. In another embodiment of the present disclosure, the electrical potential source 101 may be a battery, or another device capable of holding a charge.

Figure 3B:
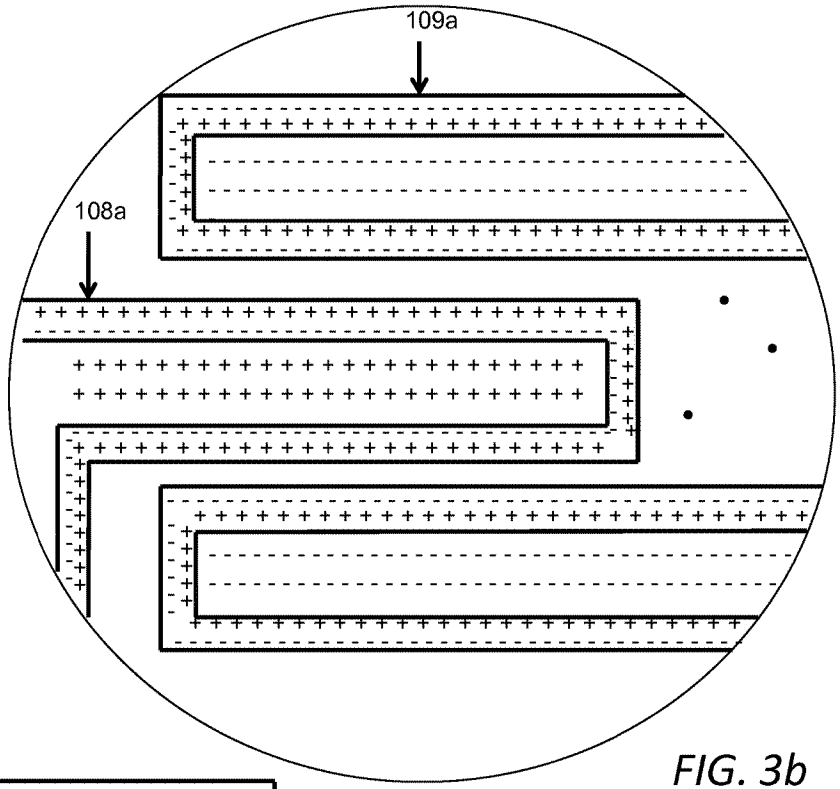
FIG. 3*b* is an enlarged view of the saw-tooth conductors depicted in FIG. 3*a;*
Figure 3A:
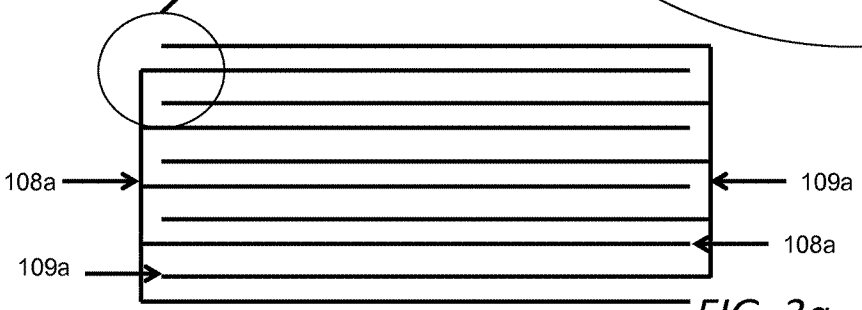
FIG. 3*a* is a cross-sectional view of one embodiment of the device depicting saw-tooth configured conductors as shown in FIG. 2.

Referring to FIG. 3*a*, in one embodiment, the first charged pair 108 contains a first multitude of teeth 108*a* and the second charged pair 109 contains a second multitude of teeth 109*a*. The first multitude of teeth 108*a* interlock with the second multitude of teeth 109*a*. As depicted in FIG. 3*b*, which is an enlarged view of the first charged pair 108 and the second charged pair 109, the first multitude of teeth 108*a* are positively charged throughout. In addition, the second multitude of teeth 109*a* are negatively charged throughout.

Figure 4:
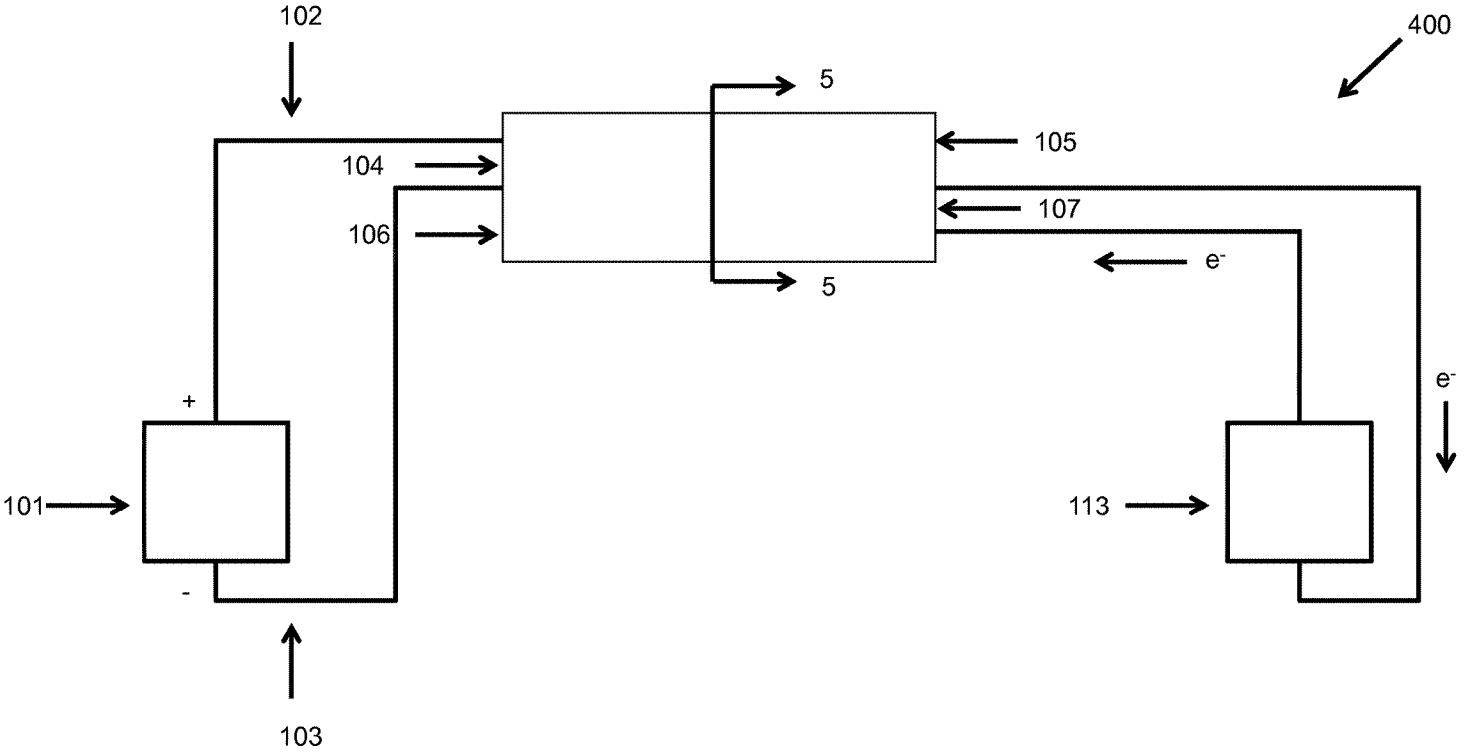
FIG. 4 illustrates schematically a device for converting radiation energy to electrical energy using cylindrically shaped materials.

Referring to FIG. 4, an alternative embodiment of a device 100 is shown as device 400 and includes first, second, third, and fourth conductive materials 104, 105, 106, 107, which are cylindrically shaped.

Figure 5:
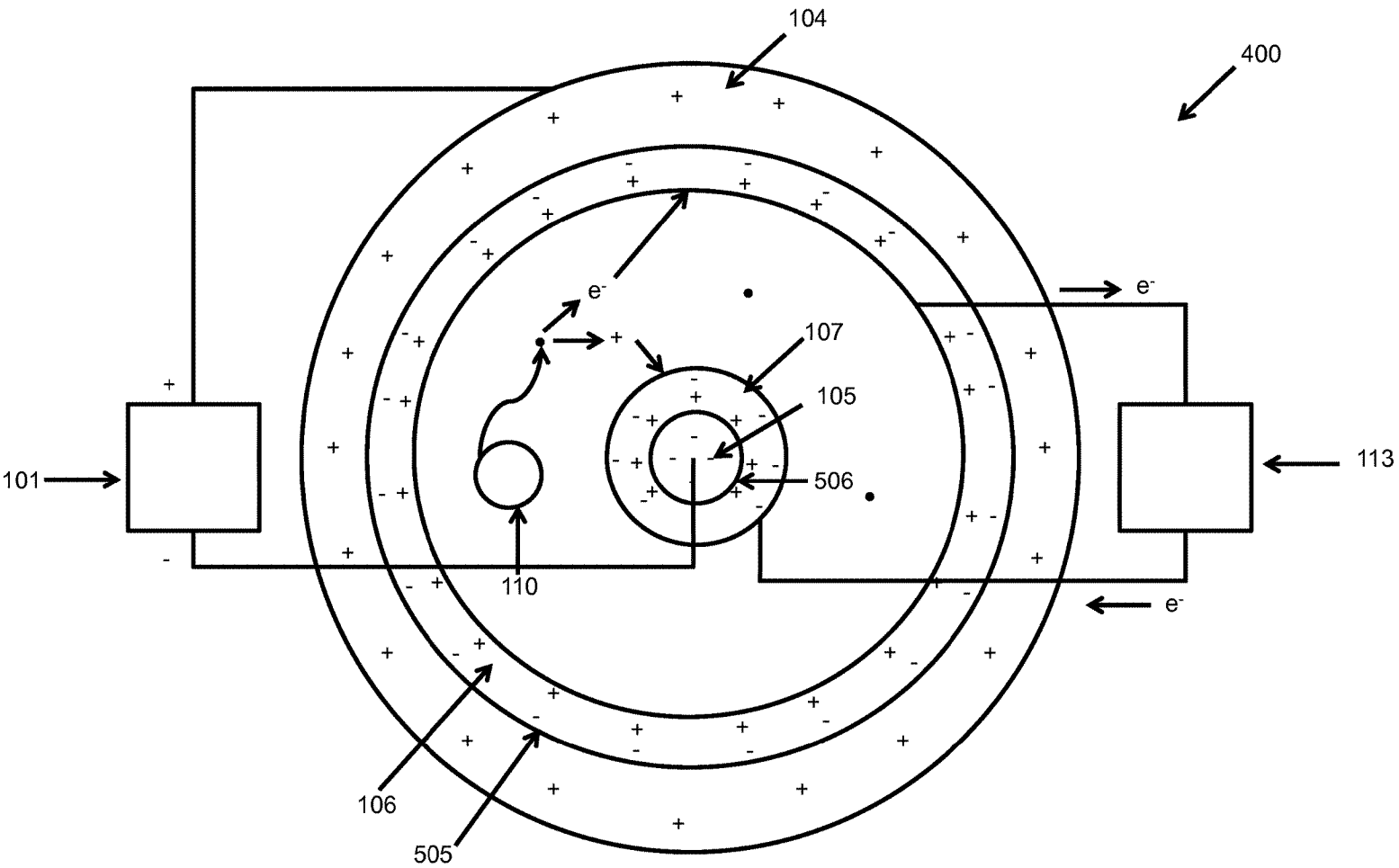
FIG. 5 is a cross-sectional schematic view taken along line 5-5 of FIG. 4.

Referring to FIG. 5, which is a cross-sectional schematic view taken along line 5-5 of FIG. 4, in one embodiment, the first conductive material 104, which is cylindrically-shaped, abuts the third conductive material 106, which is also cylindrically-shaped. There may be an electrically isolating material 505 positioned between the first conductive material 104 and the third conductive material 106 in order to decrease the likelihood of the depletion of the charge of the first conductive material 104. Furthermore, the second conductive material 105, which is cylindrically-shaped, is formed as an inner rod, and the fourth conductive material 107, which is also cylindrically-shaped, is formed as an outer rod. There may be an electrically isolating material 506 positioned between the second cylindrically-shaped conductive material 105 and the fourth conductive material 107 in order to decrease the likelihood of the depletion of the charge of the second conductive material 105. The second conductive material 105 and the fourth conductive material 107 are enclosed within the first and third conductive materials 104, 106. The radiation source 110 causes the excitation of the gas 210 (shown in FIG. 2). Exciting the gas 210 results in its ionization, which causes the separation of positive and negative particles. This results in an abundance of electrons, or negative particles, on the third conductive material 106 and build up of positive particles, or protons, on the fourth conductive material 107. The net result is the electrical current flowing through load 113 from the third conductive material 106 to the fourth conductive material 107. This electric current may be measured, for example, by an oscilloscope.

Figure 6:
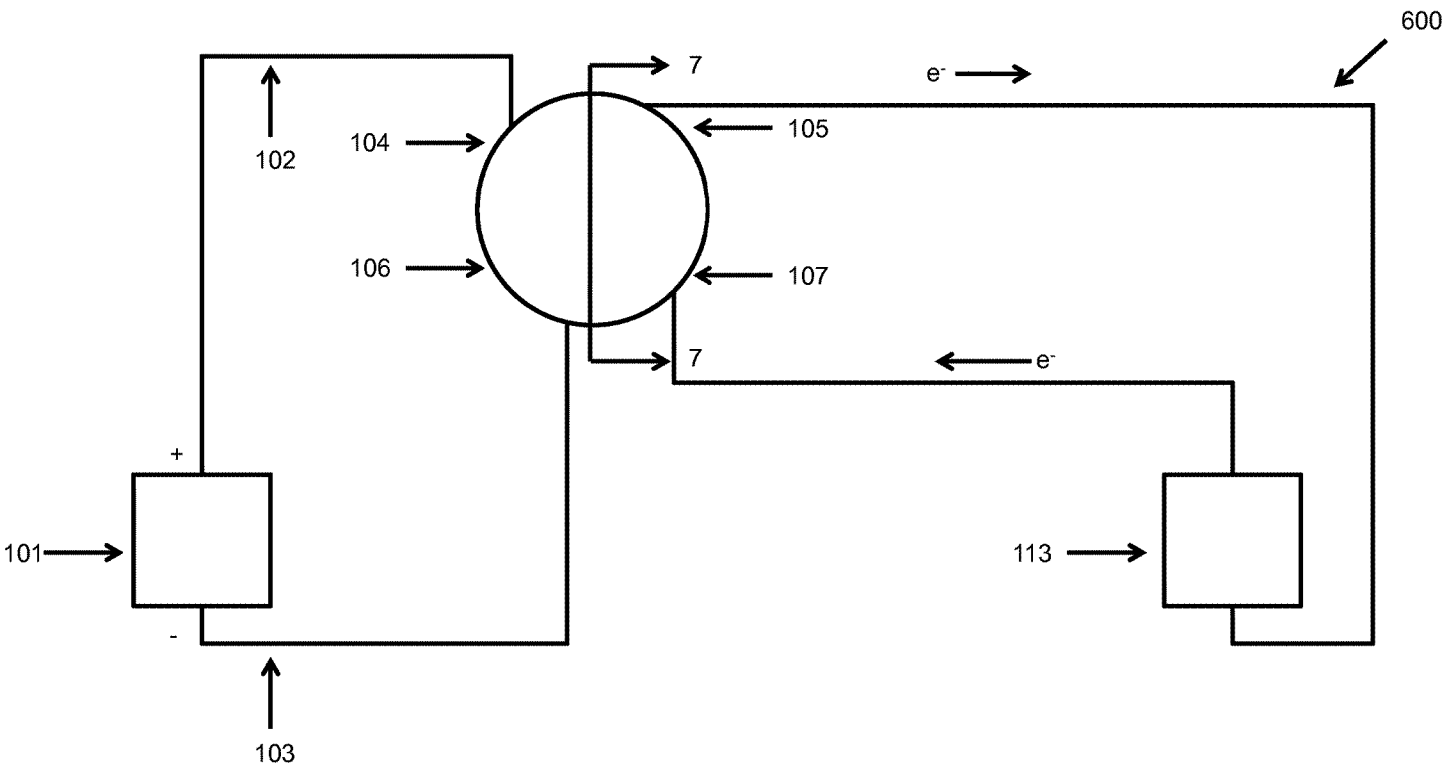
FIG. 6 illustrates schematically a device for converting radiation energy to electrical energy using spherically-shaped material.

As depicted in FIG. 6, an alternative embodiment device 100, depicted as device 600 includes first, second, third, and fourth conductive materials 104, 105, 106, 607, which are spherically shaped.

Figure 7:
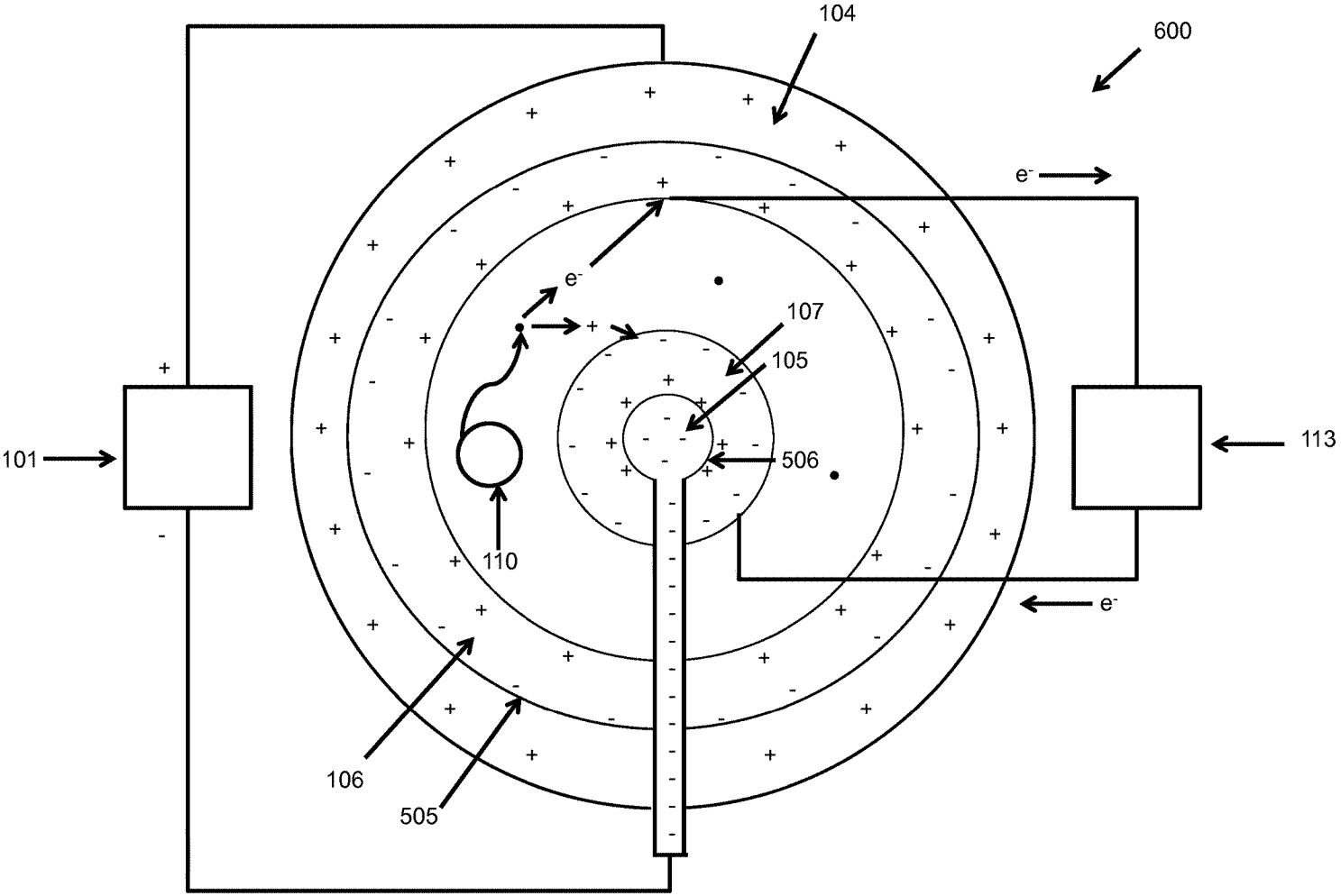
FIG. 7 is a cross-sectional schematic view taken along line 7-7 of FIG. 6.

Referring to FIG. 7, which is a cross-sectional schematic view taken along line 7-7 of FIG. 6, in one embodiment, the first conductive material, which is spherically-shaped, 104 is positioned outwardly of the third conductive material 118, which is also spherically-shaped. Electrically isolating material 505 may be positioned between the first conductive material 104 and the third conductive material 106 in order to decrease the likelihood of the depletion of the charge of the first conductive material 104. Furthermore, the second conductive material 105, which is also spherically-shaped, is formed as an inner sphere, and the fourth conductive material 107, which is also spherically-shaped, is formed as an outer sphere. Electrically isolating material 506 may be positioned between the second conductive material 105 and the fourth conductive material 107 in order to decrease the likelihood of the depletion of the charge of the second conductive material 105. The second conductive material 105 and the fourth conductive material 107 are enclosed within the first and third conductive materials 104, 106.

Figure 8:
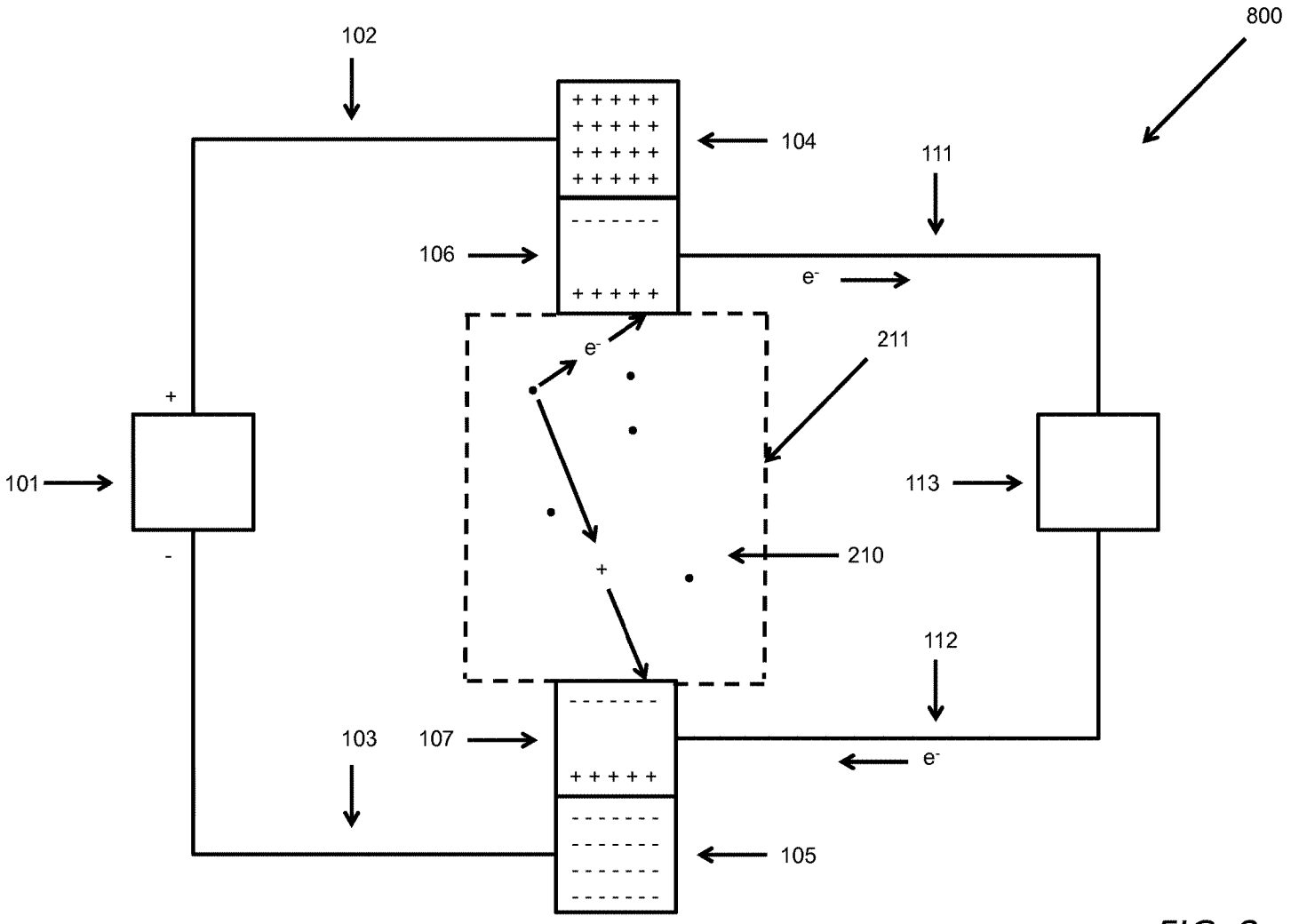
FIG. 8 illustrates schematically a the radiation receiving area of the device for converting potential energy to electrical energy.

Referring to FIG. 8, in an alternative embodiment, device 100, shown as device 800, for converting radiation energy to electrical energy includes the electrical potential source 101 having the first terminal 102 and the second terminal 193. Device 800 additionally includes the first conductive material 104 that is electrically coupled to the first terminal 102, and the second conductive material 105 that is electrically coupled to the second terminal 103. Furthermore, the third conductive material 106 abuts the first conductive material 104, and the fourth conductive material 197 abuts the second conductive material 105. As further depicted in FIG. 8, the third conductive material 106 and the fourth conductive material 107 are spaced to form the radiation receiving area 211 that is adapted to receive the gas 210. Additionally, the third and fourth conductive materials 106 and 107 are electrically coupled together though the third terminal 111 and the fourth terminal 112 to create an electrical current through load 113. In this embodiment, the radiation source 110 (shown in FIG. 1) is not present, and an electric current is generated by an electrical potential resulting from a self-ionization of the gas 210. Eventually, an ionization limit of the gas 210 will be reached, resulting in an end of the electric current through load 113.

Figure 9:
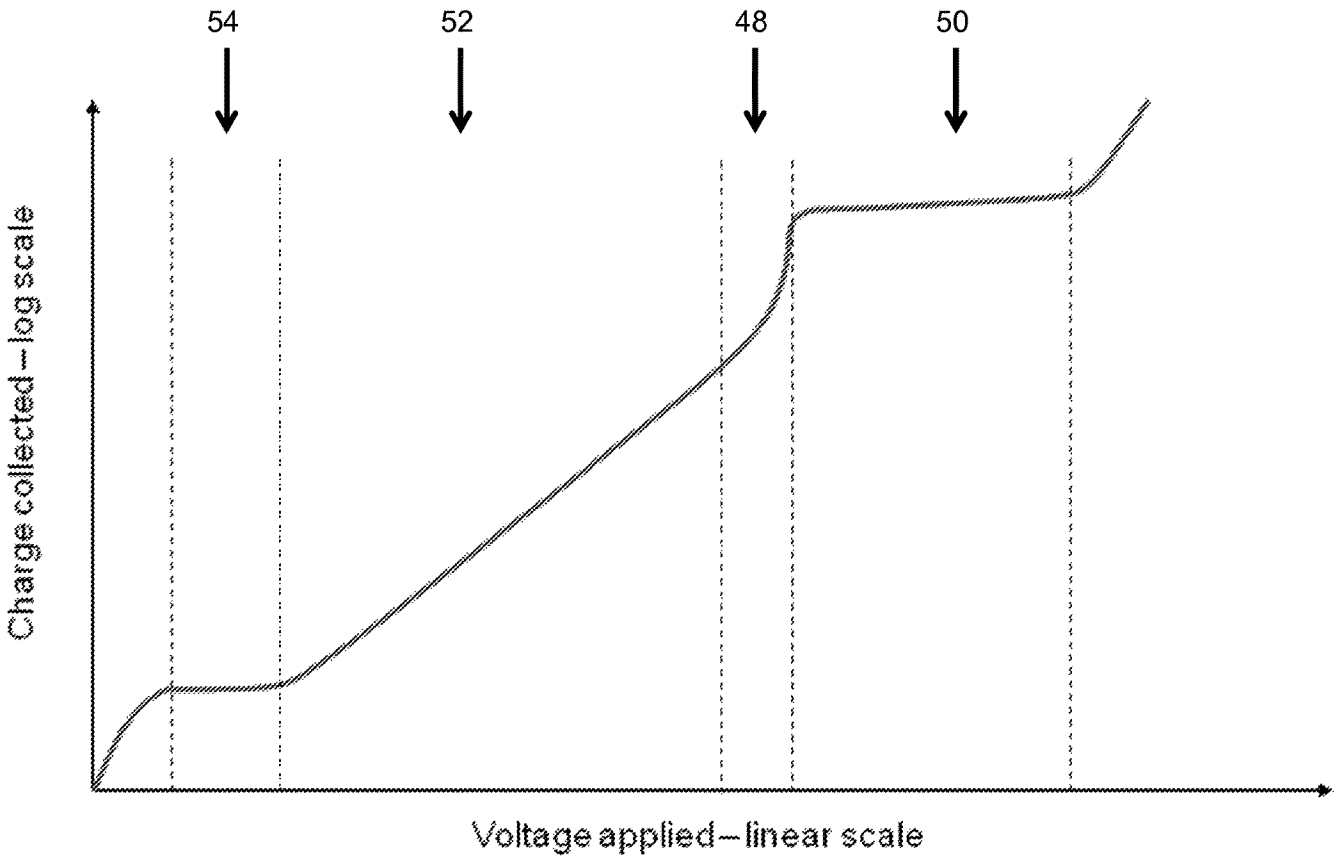
FIG. 9 illustrates graphically charges collected as a function of voltage applied.

FIG. 9 graphically illustrates charges collected as a function of voltage applied. The charges collected appear on a log scale whereas the voltage applied appears on a linear scale. The graph includes differing regions, namely the limited proportionality region 48, the Geiger region 50, the proportional counting region 52, and the ion chamber region 54. The Geiger region 50 is the plateau region immediately following the limited proportionality region 48. The Geiger region 50 is the voltage range in which the Geiger counter operates. The proportional counting region 52 is the region immediately preceding the limited proportionality region 48. The proportional counting region 52 is the voltage range in which a gas proportional counter operates. The ion chamber region 54 is the region immediately preceding the proportional counting region 52. The ion chamber region 54 is the voltage range in which an ion chamber detector operates. The preferred voltage applied is within the limited proportionality region 48. The limited proportionality region 48 is the range of operating voltages for a counter tube in which the gas amplification depends on the number of ions produced in the initial ionizing events as well as on the voltage. For larger initial ionizing events, the counter saturates. Within the limited proportionality region 48, the third conductive material 106 (shown in FIG. 1) and the fourth conductive material 107 (shown in FIG. 1) may have an electric potential difference between about 100 volts and 1600 volts, between about 100 volts and 1400 volts, between about 100 volts and 1200 volts, between about 100 volts and 1000 volts, between about 100 volts and 800 volts, between about 100 volts and 600 volts, between about 100 volts and 400 volts, between about 100 volts and 200 volts, and/or between about 100 volts and 150 volts. The preferable electrical potential difference between the third conductive material 106 (shown in FIG. 1) and the fourth conductive material 107 (shown in FIG. 1) is within the limited proportionality region 48. The Geiger region 50, the proportional counting region 52, and the ion chamber region 54, however, may also be used. Various gases may be used, such as noble gases, and preferably, xenon.

Figure 10:
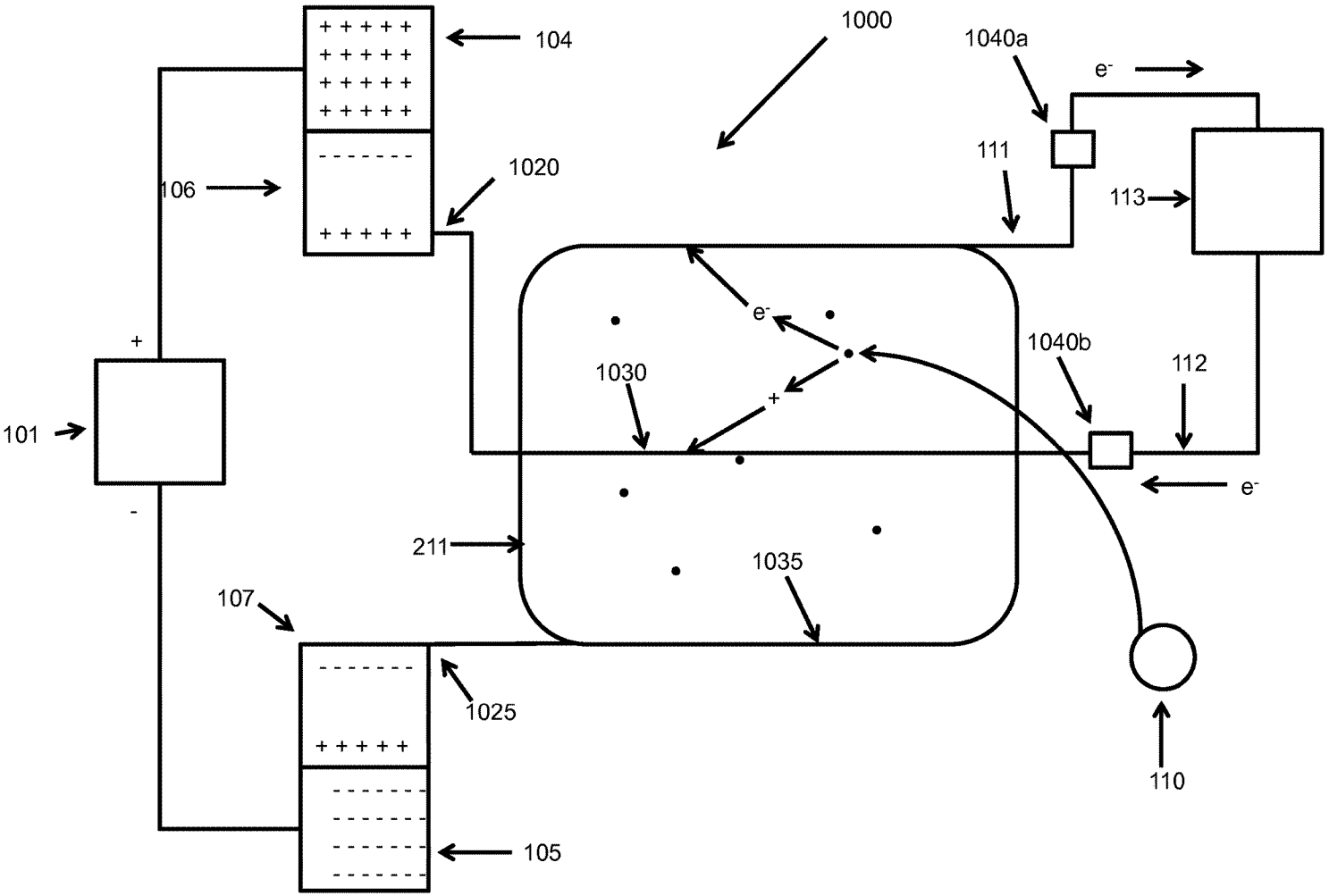
FIG. 10 illustrates schematically an alternate embodiment of a device for converting radiation energy to electrical energy including a radiation receiving area.

FIG. 10 depicts an alternative embodiment of device 100, shown as device 1000 for converting radiation energy to electrical energy, which includes the electrical potential source 101, which may comprise a battery, conductor, superconductor, or the like. The electrical potential source 101 electrically biases the first conductive material 104 such that there is a build-up of positive charges (e.g. protons) on the surface of the first conductive material 104. Additionally, the electrical potential source 101 electrically biases the second conductive material 105 such that there is a build-up of electrons (e.g. negative charges) on the surface of the second conductive material 105. The third conductive material 106 is capacitively coupled to the first conductive material 104 such that an electrical potential exists between the first conductive material 104 and the third conductive material 106. As a result of the electrical potential difference between the first conductive material 104 and the third conductive material 106, a receiving terminal 1020 of the third conductive material 106 is positively biased. Similarly, the fourth conductive material 107 is capacitively coupled to the second conductive material 105, such that as second receiving terminal 1025 of the fourth conductive material 107 is negatively biased.

In one aspect, the device 1000 comprises the radiation receiving area 211. The radiation receiving area 211 may be an enclosed space. The radiation receiving area 211 may contain any of the previously described noble gases. The radiation receiving area 211 may comprise a first portion 1030 and a second portion 1035 that are electrically isolated from each other. In one aspect, the first portion 1030 of the radiation receiving area 211 is electrically connected to the third conductive material 106 by the receiving terminal 1020. The receiving terminal 1020 may be positively biased because it is electrically connected to the third conductive material 106. In another aspect, the second portion 1035 of the radiation receiving area 211 is electrically connected to the fourth conductive material 107 by the second receiving terminal 1025. In another aspect, the load 113 is electrically connected to both the first portion 1030 of the radiation receiving area and the second portion 1035 of the radiation receiving area 211.

In one aspect, when the radiation receiving area 211 receives radiation from the radiation source 110, the received radiation particle may ionize in the noble gas residing in the radiation receiving area 211. The ionization of the radiation particles may cause the separation of positive and negative particles (e.g. atoms may lose electrons during radiation). The negative particles will be attracted to the first portion 1030 of the radiation receiving area as a result of the first portion 1030 being positively biased, and the positive particles will be attracted to the second portion 1035 of the radiation receiving area 211 as a result of the second portion 1035 being negatively biased. Due to the negative particles (e.g. electrons) collecting on the first portion 1030 of the radiation receiving area, and positive particles (e.g. protons) on the second portion 1035 of the radiation receiving area 211, an electrical current may be generated and applied to the load 113. In another aspect, diodes 1040*a* and 1040*b* may be used to direct the current in a pre-selected direction.

Figure 11B:
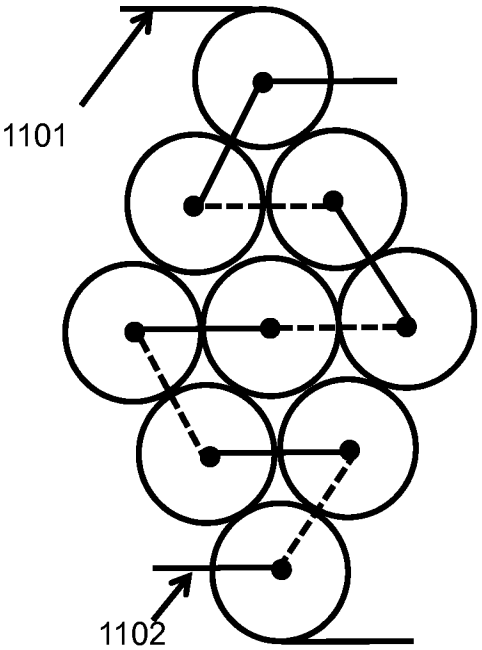
FIG. 11*b* illustrates a plurality of radiation receiving areas in a honeycomb orientation.
Figure 11A:
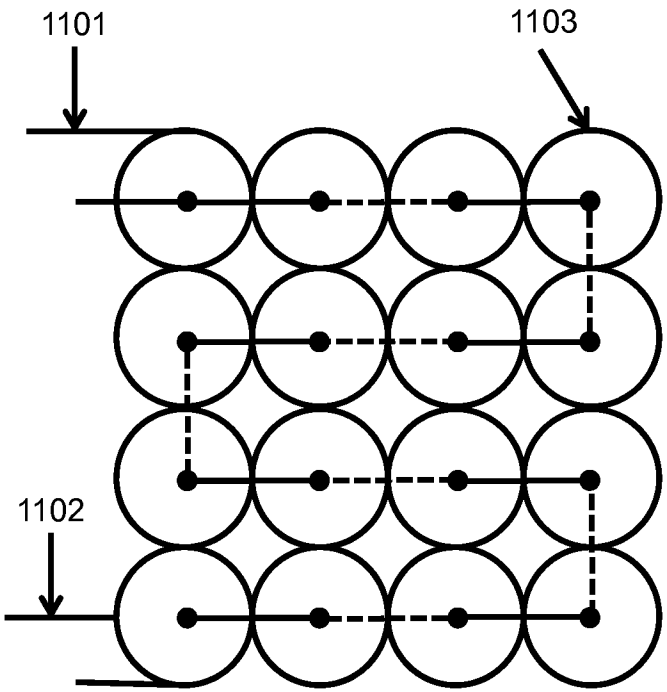
FIG. 11*a* illustrates a plurality of radiation receiving areas for receiving radiation.

Referring to FIGS. 11*a-d*, several configurations of the radiation receiving areas 211, which have been previously shown throughout this disclosure are shown. The plurality of radiation receiving areas 211 includes individual radiation receiving areas 1103. In one aspect, FIG. 11*a* depicts that radiation receiving area 211 includes a plurality of radiation receiving areas 1103. Each individual radiation receiving area 1103 comprises a positively biased conductor 1101 and a negatively biased conductor 1102. The positively biased conductor 1101 of each individual radiation receiving area 1103 is electrically coupled to adjacent positively biased conductor 1191. Similarly, the negatively biased conductor of each radiation receiving are 1103 is electrically coupled to each adjacent negatively biased conductor 1102. As a result, the individual radiation receiving areas 1103 summarily collect electrons on the positively biased conductor 1101, and summarily collect positive charges on the negatively biased conductor 1102. In one embodiment, FIG. 11*b* depicts a honeycomb configuration of the embodiment depicted in FIG. 11*a*.

Figure 11D:
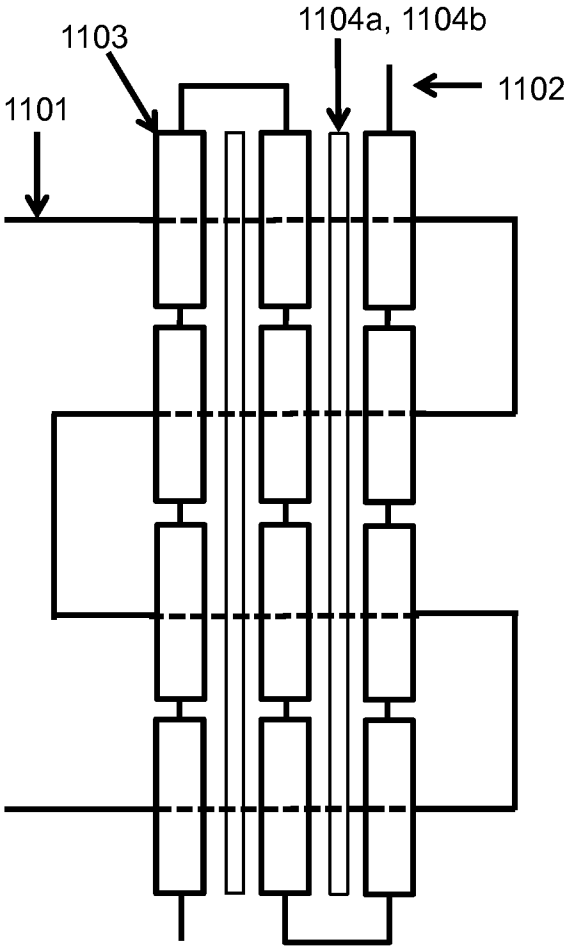
FIG. 11*d* illustrates a plurality of radiation receiving areas in columns.
Figure 11C:
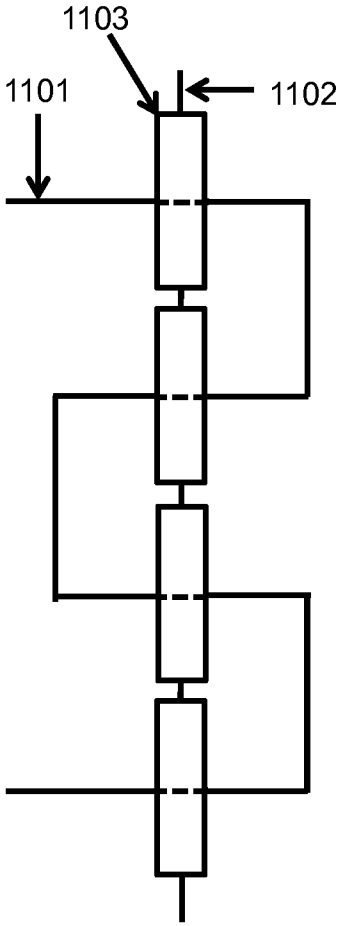
FIG. 11*c* illustrates a column of adjacent radiation receiving areas.

Referring to FIG. 11*c*, in one embodiment, a column of individual radiation receiving areas 1103 is depicted. Four radiation receiving areas 1103 are serially connected such that each individual radiation receiving area 1103 collects radiation, and together the four radiation receiving areas 1103 collect radiation communally. The third conductive material 106 (as depicted in FIG. 1) of each radiation receiving area 1103 is electrically connected by the positively biased conductor 1101 in serial such that the collection of negative particles (e.g. electrons) is cumulative. Similarly, the fourth conductive material 107 (as depicted in FIG. 1) of each radiation receiving area 1103 is electrically connected in serial by the negatively biased conductor 1102 such that the collection of positive particles (e.g. protons) is cumulative.

In one embodiment, FIG. 11*d* depicts an additional configuration of individual radiation receiving areas 1103, which are separated by a layer of electroplated strontium 90 1104*a*, 1104*b*. Three columns of four individual radiation receiving areas 1103 are shown, and each radiation receiving area 1103 is connected by the positively biased conductor 1101 and the negatively biased conductor 1102. Further, a layer of electroplated strontium 90 separates each column.

Figure 12:
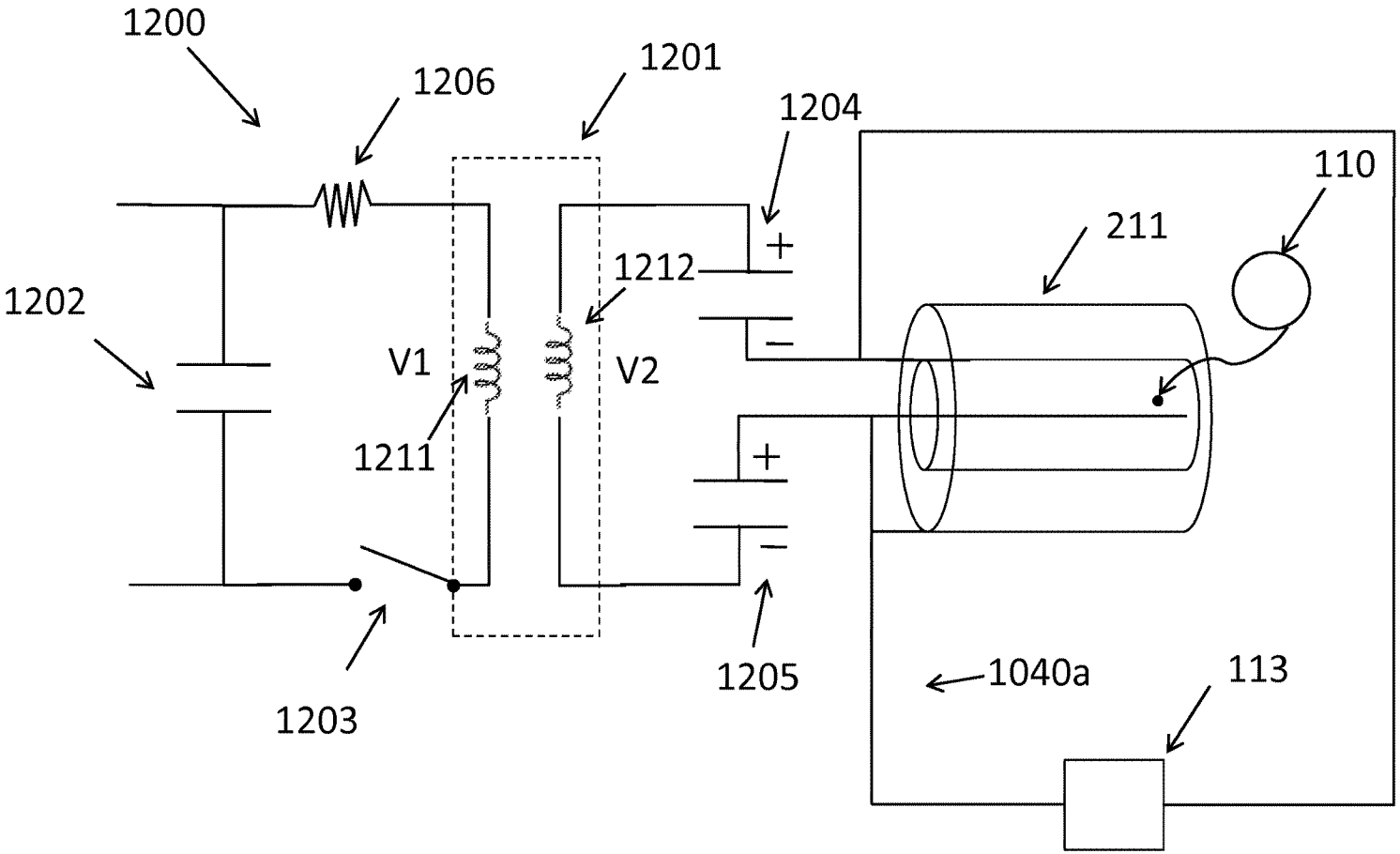
FIG. 12 illustrates a device for converting radiation energy to electrical energy utilizing alternating current.

Referring to FIG. 12, an alternative embodiment device 1200 is shown and is configured for converting radiation energy to electrical energy utilizing alternating current. In one aspect, device 1200 incorporates a resonating RLC circuit comprised of a capacitor 1202, a resistor 1206, and a transformer 1201. A resonating RLC circuit naturally oscillates at a specific frequency. These types of circuits are generally used to either generate waves of specific frequencies or to select specific frequencies from a signal. After capacitor 1202 is charged, a switch 1203 is closed which completes the circuit and provides current and voltage to transformer 1201. Transformer 1201 increases or steps up the voltage V1 to V2. Current and voltage flow through a first inductor 1211 of transformer 1201, inducing a magnetic field in a second inductor 1212 of transformer 1201, and providing voltage and current to capacitors 1204, 1205. Capacitors 1204, 1205 transfer the voltage to radiation receiving area 211 but allow little, if any, actual exchange of electrons between first portion 1030 (See FIG. 10) of the radiation receiving area and second portion 1035 (See FIG. 10) of radiation receiving area 211. Radiation receiving area 211 now has an applied voltage and can collect ions created by radiation 110, resulting in power being provided to a load 1210. As a result of the RLC circuit resonating, radiation receiving area 211 will receive current and voltage oscillating at a consistent frequency. As a result, load 113 receives current and voltage oscillating a constant frequency.

Figures 13A, 13B:
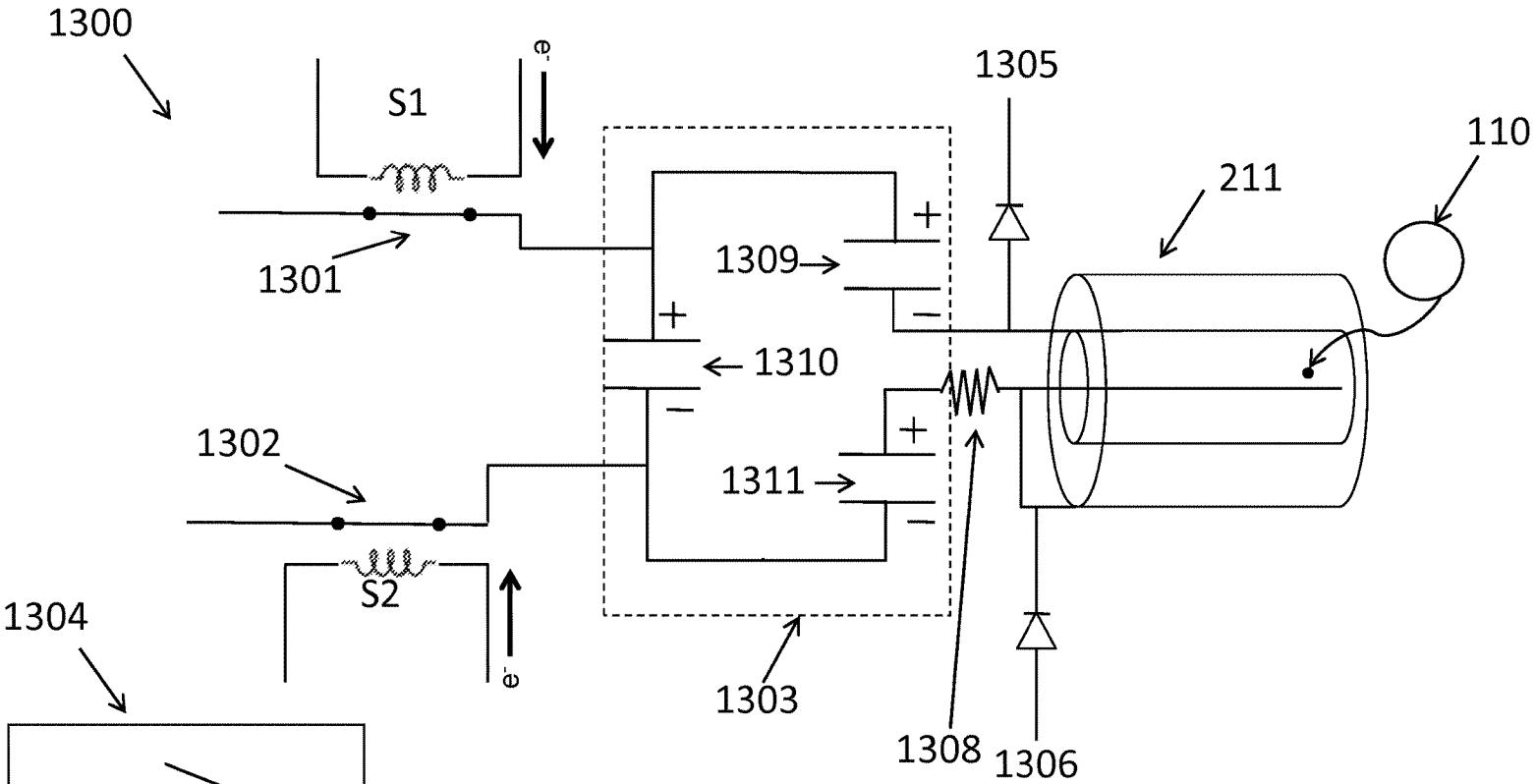
FIG. 13*a* illustrates a device for converting radiation energy to electrical energy designed for use in a nuclear reactor.
FIG. 13*b* illustrates a switch of the device of FIG. 13 in an open state.

Referring to FIG. 13*a*, device 1300 is shown for converting radiation energy to electrical energy designed for use in a nuclear reactor. In one aspect of this disclosure, device 1300 may be used to monitor the conditions of an operating nuclear reactor to determine the nuclear reactor's level of operation in the event of a power blackout situation. Power blackout situations can occur automatically when some nuclear reactors are shut down. In circumstances where a nuclear reactor needs to be shut down, a control rod is dropped into the nuclear reactor. When this happens, the control rod neutralizes the atomic reactions and renders the nuclear reactor inoperative. However, over time control rods can deteriorate or bend. If this happens the control rod may not drop down to the appropriate position to render the nuclear reactor inoperative. Additionally, device 1300 can be used for any type of nuclear reactor. For example, device 1300 may be used to detect radiation in nuclear reactors that do not use control rods. Thus a need exists for determining whether a nuclear reactor has been fully shut down if the nuclear reactor suffers a black out situation.

When a nuclear reactor is functioning properly (e.g. not shut down), current will flow though magnetic coils S1, S2. When current is passed through the magnetic coils S1 and S2, a magnetic field holds electromagnetic switches 1301, 1302 closed. When the electromagnetic switches 1301, 1302 are closed, a plurality of capacitors 1303 will be held at a predetermined voltage and kept charged because the nuclear reactor is receiving power. In the current embodiment, capacitors 1303 include three individual capacitors 1309, 1310, 1311, however the circuit could be built with any number of capacitors. Due to the layout of the three-capacitor configuration, capacitors 1309, 1310, 1311 hold their charge for a desired amount of time. If capacitors 1309, 1311 discharge due to the radiation receiving area 211 receiving radiation, part of the discharged energy from capacitors 1309, 1311 will charge capacitor 1310. As a result, capacitor 1310 will begin discharging hack into capacitors 1309, 1311. As a result of capacitor 1310 discharging into capacitors 1309, 1311, capacitors 1309, 1311 will remain charged for a longer duration of time.

In the event of a black out situation, the nuclear reactor will lose electrical power, and current will no longer pass through magnetic coils S1, S2. When current fails to flow through magnetic coils S1, S2, switches 1301, 1302 will open, as depicted in FIG. 13*b*, and the charge of capacitors 1303 will no longer be maintained by the nuclear power plants electrical system.

Capacitors 1303 provide the potential difference to the radiation receiving area 211. In the event that the nuclear reactor loses power, capacitors 1303 will remain charged for a period of time, keeping device 1300 functional after the nuclear reactor has lost power. Radiation 110 comes into the radiation receiving area 211, ionizes the inert noble gas, and radiation receiving area 211 collects charge. This charge alters the potential difference between points 1305, 1306 and alters the current through resistor 1308. By measuring electrical signal across the potential difference of point 1305 and point 1306, or by measuring the current through resistor 1308, it can be determined whether or not the reactor shut down properly in the event that the nuclear reactor loses power. In one aspect, device 1300 can be placed near each control rod of a nuclear reactor to determine if the control rods successfully stopped the nuclear reaction.

If, for example, the nuclear reactor loses power but the control rods have not successfully stopped the nuclear reactor from functioning, radiation receiving area 211 would continue to collect radiation from the nuclear reactor while the capacitors 1303 are still charged, and the potential difference between point 1305 and point 1306 would indicate that the nuclear reactor has not shut down property because radiation is being received in radiation receiving area 211. Alternatively, if the control rods have functioned properly and the nuclear reactor is no longer producing radiation, little, if any, potential difference should be detected between points 1305, 1306 because little to no radiation is being received in radiation receiving area 211. Thus by monitoring the potential difference between points 1305, 1306, one can determine if radiation is still being released by the reactor.

What is claimed is:

1. A device for converting radiation energy to electrical energy, including:

an electrical potential source having a first terminal and a second terminal;

a first conductive material electrically coupled to the first terminal;

a second conductive material electrically coupled to the second terminal;

a third conductive material capacitively coupled to the first conductive material;

a fourth conductive material capacitively coupled to the second conductive material; and a radiation receiving area;

the third conductive material and fourth conductive material being electrically coupled together to create an electrical current from an electrical potential resulting from radiation received in the radiation receiving area.

2. The device of claim 1, wherein the electrical potential source is a supercapacitor.

3. The device of claim 1, wherein the third conductive material is negatively charged and the fourth conductive material is positively charged.

4. The device of claim 1, wherein the fourth conductive material receives a negative charge from the radiation receiving area and wherein the third conductive material receives a positive charge from the radiation receiving area.

5. The device of claim 1, wherein the first conductive material and the third conductive material are separated by a first electrically isolating material.

6. The device of claim 5, wherein the second conductive material and the fourth conductive material are separated by a second electrically isolating material.

7. The device of claim 1, wherein the electrical current is configured to flow in a pre-selected direction.

8. The device of claim 1, wherein the first terminal comprises a cathode and the second terminal comprises an anode.

9. The device of claim 1, wherein the first terminal comprises a first lead and the second terminal comprises a second lead.

10. The device of claim 9, wherein the first lead and the second lead comprise aluminum.

11. The device of claim 1, wherein the third and fourth conductive materials have an electric potential difference between 100 and 150 volts.

12. The device of claim 1, wherein the third and fourth conductive materials have an electric potential difference between 75 and 100 volts.

13. The device of claim 1, wherein the first conductive material is surrounded by a first oxide material and the second conductive material is surrounded by a second oxide material.

14. The device of claim 13, wherein the first oxide material and the second oxide material comprise aluminum oxide.

15. The device of claim 1, wherein the first, second, third, and fourth conductive materials comprise aluminum.

16. The device of claim 1, wherein the radiation receiving area comprising a noble gas.

17. The device of claim 1, wherein the electrical potential source comprises a battery.

18. The device of claim 1, wherein the first, second, third, and fourth conductive materials are plate shaped.

19. The device of claim 1, wherein first, second, third, and fourth conductive materials each comprises a first plate having a first multitude of teeth and a second plate having a second multitude of teeth, wherein the first multitude of teeth are interlocked with the second multitude of teeth.

20. The device of claim 1, wherein the first, second, third, and fourth conductive materials are cylindrically shaped.

21. The device of claim 1, further comprising a rod positioned in each of the first, second, third, and fourth conductive materials.

22. The device of claim 1, wherein the first, second, third, and the fourth conductive materials are spherically shaped.

23. The device of claim 1, wherein the third and fourth conductive materials have an electric potential difference between about 100 and 1600 volts.

24. The device of claim 1, wherein the third and fourth conductive materials have an electric potential difference between about 100 and 1200 volts.

25. The device of claim 1, wherein the third and fourth conductive materials have an electric potential difference between about 100 and 1000 volts.

26. The device of claim 1, wherein the third and fourth conductive materials have an electric potential difference between about 100 and 800 volts.

27. The device of claim 1, wherein the third and fourth conductive materials have an electric potential difference between about 100 and 400 volts.

28. The device of claim 1, wherein the third and fourth conductive materials have an electric potential difference between about 100 and 200 volts.

29. The device of claim 1, wherein the third and fourth conductive materials have an electric potential difference within a limited proportionality region of a gas in the radiation receiving area.

30. The device of claim 1, further comprising a first transition metal material placed between the third conductive material and the radiation receiving area, and a second transition metal material placed between the fourth conductive material and the radiation receiving area.

31. A device for converting potential energy to electrical energy, including:

an electrical potential source having a first terminal and a second terminal;

a first conductive material electrically coupled to the first terminal;

a second conductive material electrically coupled to the second terminal;

a third conductive material coupled to the first conductive material and positioned between the second conductive material and the first conductive material; and a fourth conductive material coupled to the second conductive material and positioned between the first conductive material and the second conductive material;

the third conductive material and the fourth conductive material being spaced apart to define a space adapted to receive a gas, and the third and fourth conductive materials being electrically coupled together to create an electrical flow generated by an electrical potential resulting from a self-ionization of the gas.

32. The device of claim 31, wherein the first, second, third, and fourth conductive materials are cylindrically shaped.

33. A method of generating electrical current, comprising:

providing a radiation receiving area for receiving radiation;

providing a negatively biased conducive material;

providing a positively biased conductive material;

causing, by receiving radiation from a radiation source, a plurality of atoms to lose an electron;

receiving, by the positively biased conductive material, the plurality of electrons;

receiving, by the negatively biased material, a plurality of positively charged particles;

the negatively biased conductive material being electrically coupled to the positively biased conductive material to create an electrical current generated by the receiving radiation.

34. The method of claim 33, wherein the radiation receiving area comprising a noble gas.

35. The method of claim 33, wherein the electrical current is configured to flow in a preselected direction.

36. The method of claim 33, wherein the positively biased material and the negatively biased material have a potential difference of 100-150 volts.

37. The method of claim 33, wherein the positively biased material and the negatively biased material have a potential different of 75-100 volts.

* * * * *